United States Patent [19]

Vanmeurs et al.

[11] Patent Number: 4,640,352

[45] Date of Patent: Feb. 3, 1987

[54] IN-SITU STEAM DRIVE OIL RECOVERY PROCESS

[75] Inventors: Peter Vanmeurs; Monroe H. Waxman; Harold J. Vinegar, all of Houston, Tex.

[73] Assignee: Shell Oil Company, Houston, Tex.

[21] Appl. No.: 779,761

[22] Filed: Sep. 24, 1985

Related U.S. Application Data

[63] Continuation-in-part of Ser. No. 477,570, Mar. 21, 1983, abandoned, and a continuation-in-part of Ser. No. 609,605, May 14, 1984, abandoned.

[51] Int. Cl.[4] ..... E21B 36/04; E21B 43/24; E21B 43/30

[52] U.S. Cl. ..... 166/245; 166/57; 166/60; 166/272; 166/302

[58] Field of Search ..... 166/302, 60, 57, 245, 166/65.1, 272

[56] References Cited

U.S. PATENT DOCUMENTS

| | | | |
|---|---|---|---|
| 2,634,961 | 4/1953 | Ljungstrom | 166/302 |
| 2,732,195 | 1/1956 | Ljungstrom | 166/302 |
| 2,780,450 | 2/1957 | Ljungstrom | 166/60 X |
| 2,902,270 | 9/1959 | Salomonsson et al. | 166/302 |
| 2,914,309 | 11/1959 | Salomonsson | 166/302 X |
| 2,923,535 | 2/1960 | Ljungstrom | 166/302 X |
| 3,113,623 | 12/1963 | Krueger | 166/59 |
| 3,164,207 | 1/1965 | Thessen et al. | 166/302 X |
| 3,338,306 | 8/1967 | Cook | 166/302 |
| 3,507,332 | 4/1970 | Venable, Jr. et al. | 166/292 |
| 3,954,140 | 5/1976 | Hendrick | 166/302 X |
| 4,570,715 | 2/1986 | Van Meurs et al. | 166/302 |

*Primary Examiner*—George A. Suchfield

[57] ABSTRACT

An oil and water-containing subterranean reservoir can be heated in a manner capable of inducing an economically feasible production of oil from zones which were initially so impermeable as to be undesirably unproductive in response to injections of oil recovery fluids. Treatment zones of specified thickness are conductively heated from boreholes arranged in a specified pattern of heat-injecting and fluid-producing wells and heated to above about 600° C.

20 Claims, 7 Drawing Figures

IN-SITU STEAM DRIVE OIL RECOVERY PROCESS

RELATED APPLICATIONS

The present application is a continuation-in-part of applications Ser. No. 477,570 filed Mar. 21, 1983, now abandoned, and Ser. No. 609,605 filed May 14, 1984, also now abandoned. The disclosures of those prior applications are incorporated herein by reference.

BACKGROUND OF THE INVENTION

This invention relates to recovering oil from a subterranean oil reservoir by means of a conductively heated in-situ steam drive process. More particularly, the invention relates to treating a subterranean oil reservoir which is relatively porous and contains significant proportions of both oil and water but is so impermeable as to be productive of substantially no fluid in response to injections of drive fluids such as water, steam, hot gas, or oil miscible solvents.

Such a reservoir is typified by the Diatomite/Brown Shale formations in the Belridge Field. Those formations are characterized by depths of several hundred feet, thicknesses of about a thousand feet, a porosity of about 50%, an oil saturation of about 40 percent, an oil API gravity of about 30 degrees, a water saturation of about 60 percent—but a permeability of less than about 1 millidarcy, in spite of the presence of natural fractures within the formations. Those formations have been found to yield only a small percentage of their oil content, such as 5 percent or less, in primary production processes. And, they have been substantially non-responsive to conventional types of secondary or tertiary recovery processes. The production problems are typified by publications such as SPE Paper 10773, presented in San Francisco in March, 1982, on "Reasons for Production Decline in the Diatomite Belridge Oil Field: A Rock Mechanics View", relating to a study undertaken to explain the rapid decline in oil production. SPE Paper 10966 presented in New Orleans in September, 1982, on "Fracturing Results in Diatomaceous Earth Formations South Belridge Field California" also discusses those production declines. It states that calculated production curves representative of the ranges of the conditions encountered indicate cumulative oil recoveries of only from about 1–14 percent of the original oil in place.

A conductive heat drive for producing oil from a subterranean oil shale was invented in Sweden By F. Ljungstroem. That process (which was invented in the 1940s and commercially used on a small scale in the 1950s) is described in Swedish Pat. Nos. 121,737; 123,136; 123,137; 123,138; 125,712 and 126,674, in U.S. Pat. No. 2,732,195 and in journal articles such as: "Underground Shale Oil Pyrolysis According to the Ljungstroem Method", IVA Volume 24 (1953) No. 3, pages 118–123, and "Net Energy Recoveries for the In Situ Dielectric Heating of Oil Shale", Oil Shale Symposium Proceedings 11, page 311–330 (1978). In that process, heat injection wells and fluid producing wells were completed within a permeable near-surface oil shale formation with less than a three meter separation between the boreholes. The heat injection wells were equipped with electrical or other heating elements which were surrounded by a mass of material (such as sand or cement) arranged to transmit heat into the oil shale while preventing any inflowing or out-flowing of fluid. In the oil shale for which the process was designed and tested, a continuous inflowing of ground water required a continuous pumping out of water to avoid an unnecessary wasting of energy in evaporating that water.

U.S. Pat. No. 3,113,623 describes means for heating subterranean earth formations to facilitate hydrocarbon recovery by using a flow reversal type of burner in which the fuel is inflowed through a gas permeable tubing in order to cause combustion to take place throughout an elongated interval of subterranean earth formation.

With respect to substantially completely impermeable, relatively deep and relatively thick, potentially oil-productive deposits such as tar sands or oil shale deposits, such as those in the Piceance Basin in the United States, the possibility of utilizing a conductive heating process for producing oil would surely be—according to prior teachings and beliefs—economically unfeasible. For example, in the above-identified Oil Shale Symposium the Ljungstroem process is characterized as a process which "... successfully recovered shale oil by embedding tubular electrical heating elements within high-grade shale deposits. This method relied on ordinary thermal diffusion for shale heating, which, of course, requires large temperature gradients. Thus, heating was very non-uniform; months were required to fully retort small room-size blocks of shale. Also, much heat energy was wasted in underheating the shale regions beyond the periphery of the retorting zone and overheating the shale closest to the heat source. The latter problem is especially important in the case of Western shales, since thermal energy in overheated zones, cannot be fully recovered by diffusion due to endothermic reactions which take place above about 600° C. (page 313).

In substantially impermeable types of subterranean formations, the creating and maintaining of a permeable zone through which the heated oil or pyrolysis products can be flowed has been found to be a severe problem. In U.S. Pat. No. 3,468,376, it is stated (in Cols. 1 and 2) that "There are two mechanisms involved in the transport of heat through the oil shale. Heat is transferred through the solid mass of oil shale by conduction. The heat is also transferred by convection through the solid mass of oil shale. The transfer of heat by conduction is a relatively slow process. The average thermal conductivity and average thermal diffusivity of oil shale are about those of a firebrick. The matrix of solid oil shale has an extremely low permeability much like unglazed porcelain. As a result, the convective transfer of heat is limited to heating by fluid flows obtained in open channels which traverse the oil shale. These flow channels may be natural and artificially induced fractures ... On heating, a layer of pyrolyzed oil shale builds adjacent the channel. This layer is an inorganic mineral matrix which contains varying degrees of carbon. The layer is an ever-expanding barrier to heat flow from the heating fluid in the channel." The patent is directed to a process for circulating heated oil shale-pyrolyzing fluid through a flow channel while adding abrasive particles to the circulating fluid to erode the layer of pyrolyzed oil shale being formed adjacent to the channel.

U.S. Pat. No. 3,284,281 says (Col. 1, lines 3–21), "The production of oil from oil shale, by heating the shale by various means such as ... an electrical resistance heater ... has been attempted with little success .... Fracturing of the shale oil prior to the application of heat thereto by in situ combustion or other means has been practiced with little success because the shale swells upon heating with consequent partial or complete closure of the fracture." The patent describes a process of sequentially heating (and thus swelling) the oil shale, then injecting fluid to hydraulically fracture the swollen shale, then repeating those steps until a heat-stable fracture has been propagated into a production well. U.S. Pat. No. 3,455,391 discloses that in a subterranean earth formation in which hydraulically induced fractures tend to be vertical fractures, hot fluids can be flowed through the vertical fracture to thermally expand the rocks and close the fractures so that fluid can be injected at a pressure sufficient to form horizontal fractures.

SUMMARY OF THE INVENTION

The present invention relates to heating a subterranean reservoir so that oil is subsequently produced from the reservoir. At least two wells are completed into a treatment interval having a thickness of at least about 100 feet within an oil and water-containing zone which is both undesirably impermeable and non-productive in response to injections of oil-displacing fluids. The wells are arranged to provide at least one each of heat-injecting and fluid-producing wells having boreholes which, substantially throughout the treatment interval, are substantially parallel and are separated by substantially equal distances of at least about 20 feet. In each heat-injecting well, substantially throughout the treatment interval, the face of the reservoir formation is sealed, in order to keep fluid from flowing between the interior of the borehole and the reservoir, with a solid material or cement which is relatively heat conductive and substantially fluid impermeable. In each fluid-producing well, substantially throughout the treatment interval, fluid communication is established between the well borehole and the reservoir formation and the well is arranged for producing fluid from that formation. The interior of each heat-injecting well is heated, at least substantially throughout the treatment interval, at a rate or rates capable of (a) increasing the temperature within the borehole interior to at least about 600° C. without causing it to become high enough to thermally damage equipment within the borehole while heat is being transmitted away from the borehole at a rate not significantly faster than that permitted by the heat conductivity of the reservoir formation.

DESCRIPTION OF THE INVENTION

Figure 1:
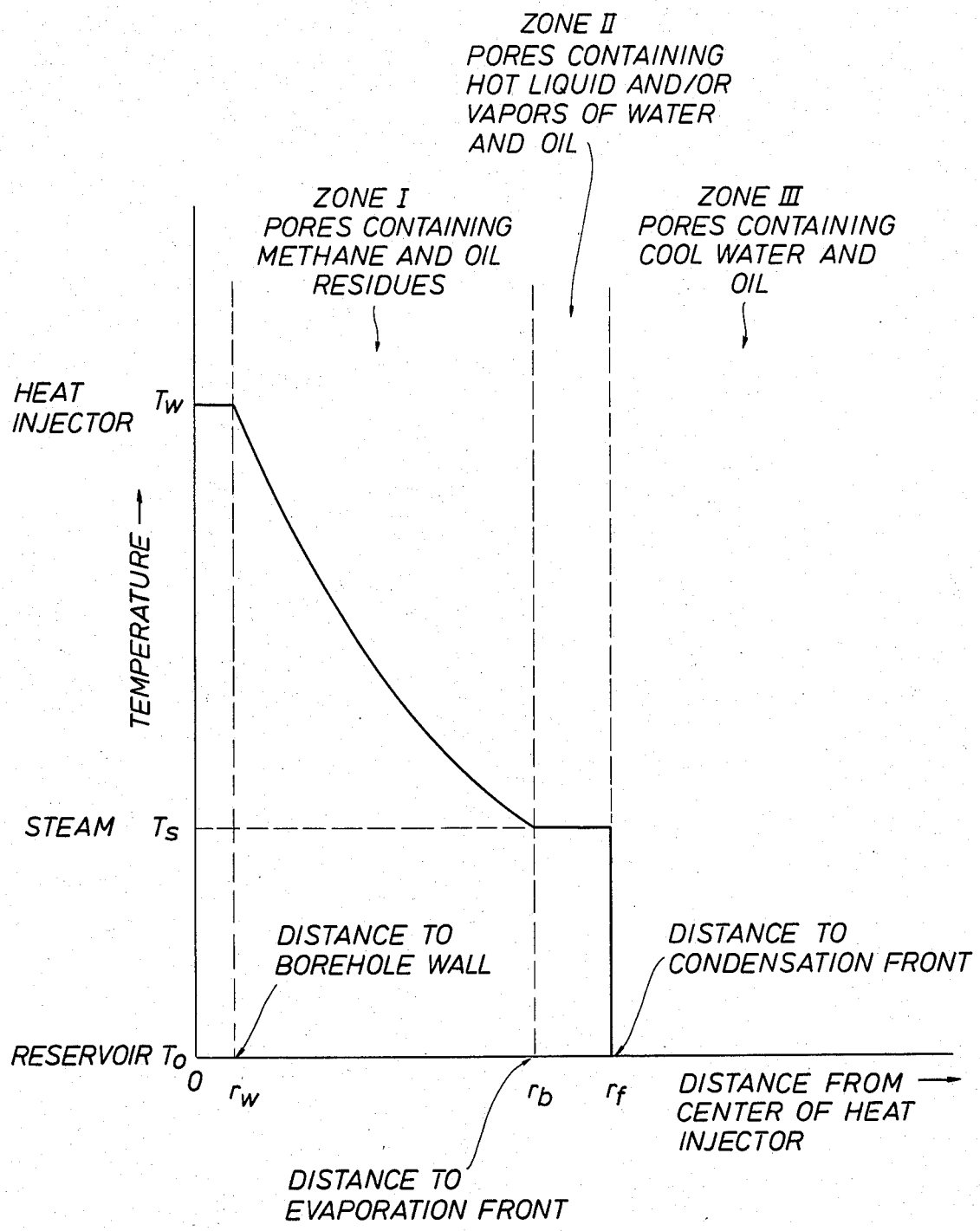
FIG. 1 is a schematic illustration of the temperature distribution around the heat injector at a typical stage of the present process.

The present invention is, at least in part, premised on a discovery that when the presently specified type of reservoir is treated as presently specified, the process functions as though it involves a mechanism such as the following.

The injected heat penetrates the formation by conduction only. However, when the formation temperature rises to say 250°–300° C. both water and hydrocarbon vapor are formed and, due to expansion of these fluids high pressures are generated. Under the influence of the generated pressure gradients the fluids flow toward the production wells, either at the slow rate permitted by the low native permeability or otherwise through fractures which are generated or extended into interconnections when the pore pressure approaches overburden pressure.

When the steam and the hydrocarbon vapor move toward the production wells they condense in cooler parts of the formation and the release of latent heat preheats the formation to a "steam" temperature about equalling the temperature of wet steam at the overburden pressure. In this manner, some heat is transported by convection, thus speeding up the process over what would have been the case if all of the heat were transmitted by conduction.

Such a generating, pressurizing and displacing of steam and hydrocarbon vapor through portions of the oil-containing reservoir amounts to an in situ generated steam drive. The drive has many features of the so-called "steam distillation drive" described in "Laboratory Studies of Oil Recovery by Steam Injection", AIME Transactions, July, page 681, by B. T. Willman, V. V. Valleroy, G. W. Runberg, A. J. Cornelius and L. W. Powers (1961). As such, many of the phenomena observed in the steam distillation drive can be expected to occur also in the present process, particularly with respect to the mixing of the hydrocarbon condensate with the virgin oil in the cooler part of the formation. This hydrocarbon condensate is more volatile and less viscous than the virgin oil. When the evaporation front reaches a place where virgin oil has previously been diluted with hydrocarbon condensate, the resulting pressurized steam distillation of the diluted oil causes a larger fraction of the oil to vaporize than when virgin oil is heated to the same temperature and pressure. This mechanism may increase the displacement efficiency of the in situ generated steam drive aspect of the present process above what could be expected from simple steam distillation of the virgin crude.

In addition, Applicants have now discovered that, although the process as described in the parent application is generally useful, in certain situations it is advantageous to employ the following procedures. A preferred way of forming a fluid impermeable barrier between the reservoir and the portion of the borehole in which the heater is located is to dispose the heater within a casing or tubing string which is closed at the bottom and is surrounded by a heat stable and heat conductive material such as cement. A particularly suitable rate of generating heat within the heat-injecting wells is about 340 to 680 BTU per foot, per hour, or when heating electrically, operating an electrical resistance heater at about 100 to 200 watts per foot. Examples of generally suitable rates are inclusive of 80 to 220 watts per foot or the equivalent rate in BTU's. In a reservoir formation (such as the Diatomite/Brown Shale formation) which has a tendency to undergo compaction and subsidence around a borehole in which the fluid pressure is relatively low, the fluid pressure in the fluid-producing wells should be kept high enough to prevent the compaction. In such situations, the heating is preferably continued in the heat-injecting wells until fluid is displaced into at least one fluid-producing well. The outflowing of fluid from each fluid-producing well into which fluid is displaced is preferably restricted to the extent necessary to increase the fluid pressure within the well by an amount sufficient to prevent significant compaction of the adjacent formation. In general, such an increase in the borehole fluid pressure should result in an increase in reservoir fluid pressure of about 100 to 200 psi above the natural fluid pressure in the adjacent earth formations. At the heat-injecting wells the gas pressure developed (steam, methane, etc.) keeps the pore pressure high and prevents compaction. Compaction may occur in Diatomite when the effective pressure exceeds about 500 psi, independent of temperature, e.g., when the overburden pressure minus the fluid pressure within the reservoir, i.e., the effective stress, amounts to about 500 psi or more.

Thus, although the present invention is not dependent upon any particular mechanism, it functions as though at least a significant aspect of it consists of a steam distillation drive where the steam is generated in situ by heat flowing by conduction from very hot injection wells.

FIG. 1 illustrates schematically the temperature distribution around a heat injector at a typical stage of the present process. It will be assumed that the heat flows radially so that the formation temperature is a function only of the distance r to the center of the heat injector.

In Zone I of FIG. 1 all the water has evaporated. For all practical purposes heat flow is by conduction only. Heat conduction flows with radial symmetry have in common that over a surprisingly large region the temperature varies linearly with the logarithm of r. This is equivalent to saying that in Zone I the temperature distribution can be accurately described by the steady state solution of a differential equation.

The pore volume in Zone I contains a small amount of heavy hydrocarbon residue in liquid or solid form. This residue forms a relatively small fraction of the original oil in place and consists of the heavy components of the crude oil which were not vaporized by steam distillation. At the prevailing temperatures in Zone I (e.g., 300°–800° C.) these hydrocarbons are subject to cracking and will yield coke and light hydrocarbon gases, which gases will displace most of the steam initially present. For this reason we shall assume that in Zone I the pore space which is not occupied by the heavy hydrocarbons is filled with methane. In other words, no water is present in any form in Zone I.

In Zone II of FIG. 1 the temperature has been assumed to be constant. This zone is the equivalent of the steam zone in a conventional steam drive. The value of the pressure in Zone II will be assumed to be equal to overburden pressure and the temperature equal to steam temperature at this pressure. The rationale behind this assumption is that the permeability of the Diatomite/-Brown Shale formations is so low in many places that the pressure may have to rise to fracturing pressure in order to provide a flow path for the water and hydrocarbon vapors.

In the present process, as in a steam drive, most of the oil displacement, including steam distillation of oil, can be expected to occur near the condensation front ($r_f$). Therefore, we shall assume that the pore space in Zone II is filled with water and steam at a saturation $S_w^{II}$ corresponding to the initial water saturation, and contains oil at saturation $S_o^{II}$.

In Zone III the pore volume contains the reservoir water and oil at substantially their initial temperature and saturation.

As mentioned before, contrary to most oil displacement processes, the vertical sweep efficiency in the present process is not determined by the properties of the formation but by the properties of the heater (at least in first order of approximation). Ideally, the heat injection rate would be substantially constant from top to bottom of the heater, so that the injection profile would be substantially uniform. Where the heater is electric, the heat injected per unit thickness of formation is $q_H^I = i^2\nu/A$, where i is the electric current through the heater, A is its cross sectional area and $\nu$ the electric resistivity of the heating wire.

In second order approximation the electric resistivity of a heating wire increases with temperature. A section of heating wire opposite a stratum having a lower heat conductivity will become hotter and therefore more resistive than the section opposite a layer having a higher heat conductivity. Therefore, paradoxically, somewhat more heat will be injected into a layer with a lower heat conductivity.

During the early part of the present process heat will flow radially outward away from the injectors in a pattern of wells. This situation may be maintained until the leading edges of two adjacent hot zones begin to overlap. From then on the temperature at the point midway between two adjacent injectors will rise faster (because the midpoint receives heat from two directions) than at a point at the same distance from the heat injector but in the direction of the production well. We, therefore, have another paradoxical situation that the isotherms after first being circular around the injection wells and growing radially outward, will tend subsequently to cusp toward each other, thus rapidly heating the area midway between adjacent heat injectors. This is exactly the spot which is normally bypassed in oil displacement processes, causing a reduced sweep efficiency.

In the present process, on the contrary, we can expect very high horizontal sweep efficiencies, since the oil is displaced by the thermal gradient and that gradient is selectively directed to surround and be directed inward toward a production well.

We have assumed before that, in the present process, as in most steam drives, oil displacement takes place at the steam condensation front ($r_f$). Consistent with that model, the cumulative oil production will be proportional to the size of the hot zone. Since during the early part of the process the heat injection rate will be higher (assuming constant temperature of the heat injector), the growth rate of the heated part of the reservoir will also be higher and therefore the oil production rate larger. Later on the heat injection rate will decline and so will the oil production rate.

At the initiation of the present process most of the reservoir formation will be close to original oil and water saturation. In the absence of gas this would mean that oil which is displaced from the hot zone into the cooler part of the reservoir cannot significantly increase the initial oil saturation. Therefore, we can expect that the liquids which are displaced from the hot zone will quickly cause a production of oil by the production wells, at least in those layers containing little gas. For example, in a Diatomite/Brown Shale formation in the Belridge Field at a depth of about 1200 feet, when the interior of the heat injecting well is maintained at a temperature of about 500° to 700° C. and the well spacing is about 50 feet, fluid will be displaced into the production well within about two years.

Both the oil production rate and the cumulative oil production are strongly affected by the amount of oil remaining after the passage of Zone II. Preliminary experiments have indicated that about 70% by weight of a virgin oil such as the Belridge diatomite oil, is steam distillable. If, however, hydrocarbon condensate mixes with the original oil (and displaces part of it), a larger fraction of the mixture will evaporate and more than 70% of the oil may be recoverable. In the numerical example discussed later, however, we have assumed only 60% recovery.

A factor which could negatively affect the cumulative oil production is the geometry of the wells. The well spacing will have to be exceptionally dense in order to heat up the formation to process temperature in a reasonably short period of time. Preferred well distances may be as small as 65 feet. It is obvious that the boreholes of these wells should be nearly vertical, or at least substantially parallel, at least within the treatment interval within the reservoir, and that deviations from vertical or parallel of more than a few feet could seriously affect the horizontal sweep efficiency and thus the cumulative oil recovery.

Heat requirement is defined as the amount of heat injected per barrel of oil produced. From the economic point of view this parameter is of prime importance. Where electric resistance heating is used, the heat is expensive and the cost of electricity per barrel of oil produced will be significant. The presently described model is somewhat optimistic in terms of process heat requirements. This is due to the fact that heat conduction ahead (downstream) of the condensation front has been neglected. In a steam drive using injected steam a similar assumption would be more accurate because the speed of propagation of the steam front is much higher. In the present process all fronts move very slowly and significant amounts of heat will move ahead of the condensation front. Later we shall make an estimate of the size of this error. Heat losses to cap and base rock have also been neglected; but, this amount of heat loss is small compared to that lost downstream of the condensation front.

Where electric heating is used, the greater the electric current in the heating wire, the higher will be the heat injection rate. The temperature of the heating wire, however, will be higher also. At too high a temperature the heating wire would melt and a heat injector would be lost.

It is possible to install electric heaters that can operate at temperatures as high as 1200° C. We propose, however, to keep the maximum temperature of the heating wire below about 900° C. in order to prevent injector failure requiring a redrilling operation. In general, the rate of heating is adjusted to the extent required to maintain a borehole interior temperature at the selected value without causing it to become high enough to damage well equipment while the injected heat is being transmitted away from the well at a rate not significantly faster than that permitted by the heat conductivity of the reservoir formation. Such a rate of heating can advantageously be provided by arranging electrical resistance heating elements within a closed bottomed casing so that the pattern of the heater resistances along the interval to be heated is correlated with the pattern of heat conductivity in the earth formations adjacent to that interval and operating such heating elements at an average rate of about 100 to 200 watts per foot of distance along the interval, for example, as described in the commonly assigned patent application Ser. No. 597,764 filed Apr. 6, 1984.

The following hypothetical examples provide calculations of the more significant process variables, evaluated for a set of specific process parameters more or less representative of the Diatomite/Brown Shale formations in the Belridge Field. The calculations evaluate an "average" case characterized by the parameter values given in Table 1.

TABLE 1

PROCESS PARAMETERS

| Project Area | | 1000 acres |
|---|---|---|
| $h$ | Formation thickness | 1100 feet |
| $C_g^I$ | Specific heat of gas in Zone 1 | 0.6 cal/gram °C. |
| $C_m$ | Specific heat of rock minerals | 0.2 cal/gram °C. |
| $C_o^I$ | Specific heat of non-gaseous hydrocarbon in Zone I | 0.4 cal/gram °C. |
| $C_o^{II}$ | Specific heat of non-gaseous hydrocarbon in Zone II | 0.4 cal/gram °C. |
| $C_w^{II}$ | Specific heat of water in Zone II | 1.0 cal/gram °C. |
| $H_s$ | Heat content of 1 gram of steam | 640 cal/gram |
| $r_w$ | Radius of heat injector | 10 cm |
| $S_g^I$ | Hydrocarbon gas saturation in Zone I | 0.9 |
| $S_o^I$ | Saturation of non-gaseous hydrocarbon in Zone I | 0.1 |
| $S_o^{II}$ | Saturation of non-gaseous hydrocarbon in Zone II | 0.145 |
| $S_{oi}$ | Initial oil saturation | 0.36 |
| $S_s$ | Steam saturation in Zone II | 0.255 |
| $S_w^{II}$ | Water saturation in Zone II | 0.6 |
| $S_{wi}$ | Initial water saturation | 0.6 |
| $T_o$ | Original reservoir temperature | 40° C. |
| $T_s$ | Steam temperature | 300° C. |
| $T_w$ | Temperature of heat injector | 800° C. |
| $\phi$ | Porosity | 0.55 |
| $\beta$ | Coefficient of temperature dependence of heat conductivity of formation | $3 \times 10^{-4}$/°C. |
| $\lambda_o$ | Value of $\lambda$ at 0° C. | $10^{-3}$ cal/second cm °C. |
| $\rho_g^I$ | Density of hydrocarbon gas in Zone I | 0.04 gram/cm$^3$ |
| $\rho_m$ | Density of rock minerals | 2.5 gram/Cm$^3$ |
| $\rho_o^I$ | Density of non-gaseous hydrocarbon in Zone I | 1.0 gram/cm$^3$ |
| $\rho_o^{II}$ | Density of non-gaseous hydrocarbon in Zone II | 0.9 gram/cm$^3$ |
| $\rho_s$ | Density of steam | 0.04 gram/cm$^3$ |
| $\rho_w^{II}$ | Density of water in Zone II | 0.7 gram/cm$^3$ |

Figure 2:
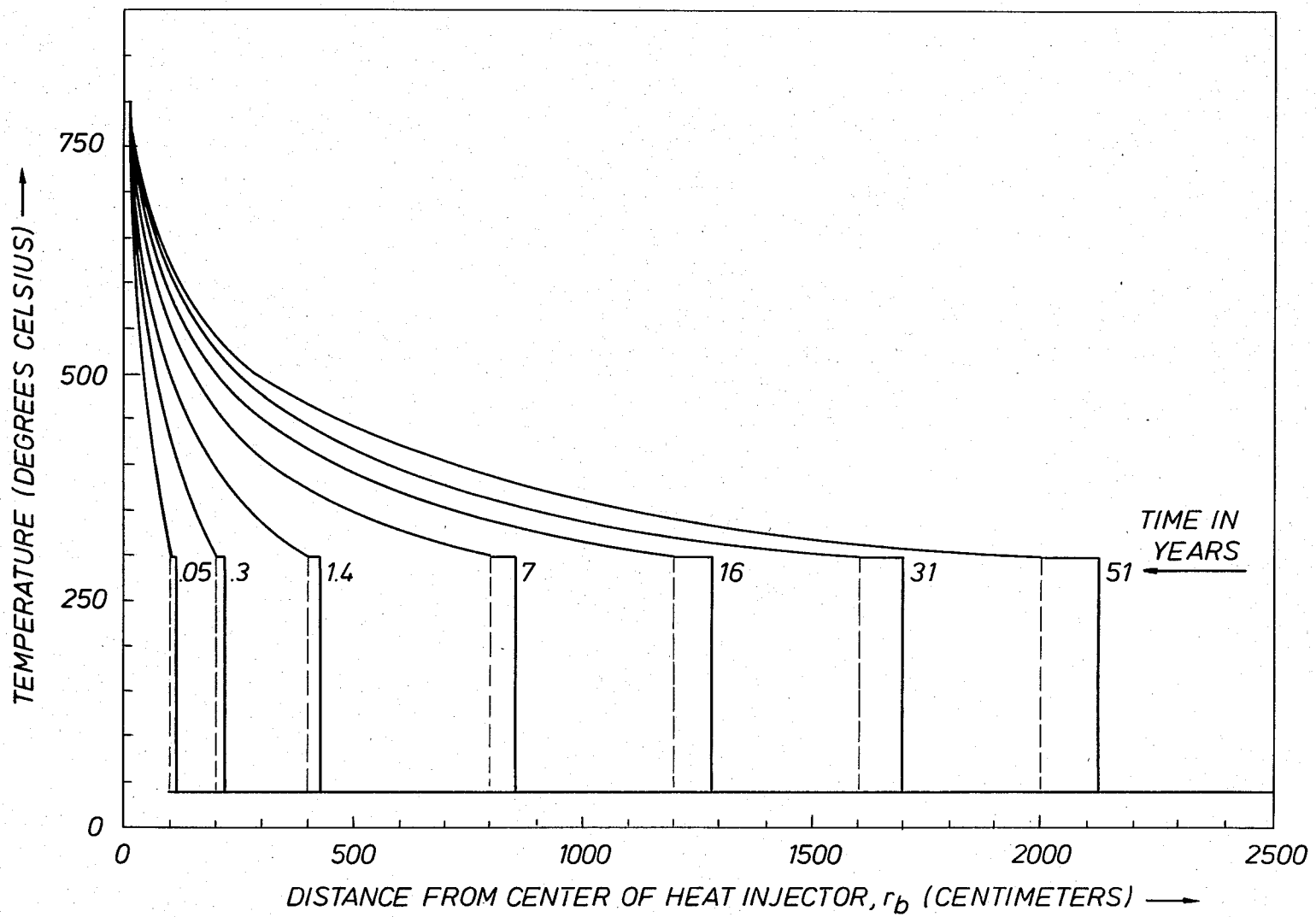
FIG. 2 similarly illustrates such temperature distributions at different stages of the process.

FIG. 2 illustrates various temperature distributions around a heat injector as determined for different values of $r_b$ corresponding locations of the condensation fronts (identified by the respective dashed and solid lines, as shown on FIG. 1). A striking feature shown by FIG. 2 is that only a relatively small fraction of the formation is heated to very high temperatures. For instance, the 500° C. isotherm does not move more than 10 feet away from the heat injector by the time the evaporation front is 50 feet away from the heat injector. Furthermore, FIG. 2 illustrates that the size of the steam zone (Zone II, as shown on FIG. 1) remains rather small. This is especially important in view of the fact that we have ignored the heat content of the formation downstream of the condensation front. This heat, flowing by conduction ahead of the steam front, would have to be supplied by reducing the size of the steam zone even more. We may therefore conclude that only a small fraction of the formation is actually at steam temperature. Most of the formation is either hotter (and dry) or cooler than steam temperature.

Figure 3:
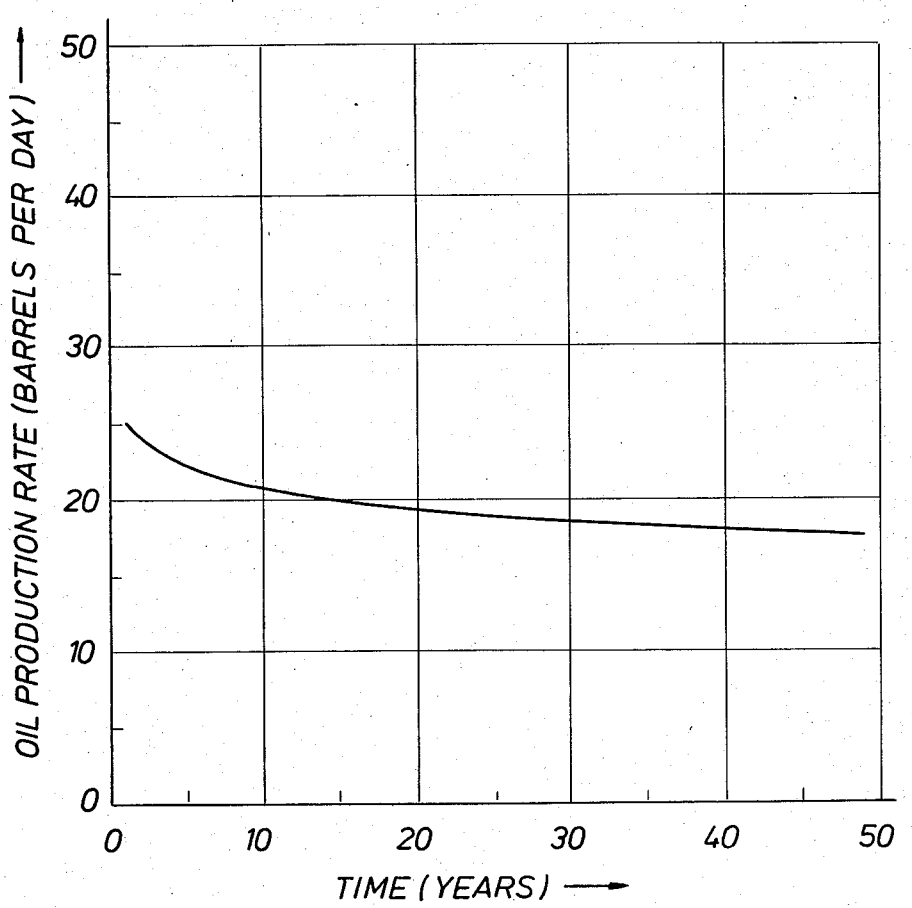
FIG. 3 is a plot of oil production rate with time for each heat injection well.

FIG. 3 shows the oil production rate. It should be noted here that the "oil production" amounts to the oil displaced from the neighborhood of a heat injector. Since high sweep efficiencies can be expected in the present process, most of the displaced oil will be produced. In the case of a five-spot well pattern there is one producer per injector and therefore FIG. 3 may relatively accurately describe the production of oil per producer. This is especially so since little interference between injection wells will take place until most of the oil (80%) has been produced.

In the case of a seven-spot pattern the hot zones of neighboring heat injectors will start overlapping significantly when about 60% of the oil has been produced. On the other hand, the seven-spot pattern contains two heat injectors for every production well and therefore the initial oil production rate per producer will be twice as high as in the case of the five-spot pattern. When the hot zones of adjacent injectors start overlapping both heat injection rate and oil production rate should start declining faster than calculated by a radial model. Overall, however, the initial higher production rate in the case of a seven-spot pattern should outweigh the later, more rapid decline. So, especially since heat injectors can be expected to require less expensive well equipment than production wells, the seven-spot pattern should be preferable to the five-spot pattern.

Figure 4:
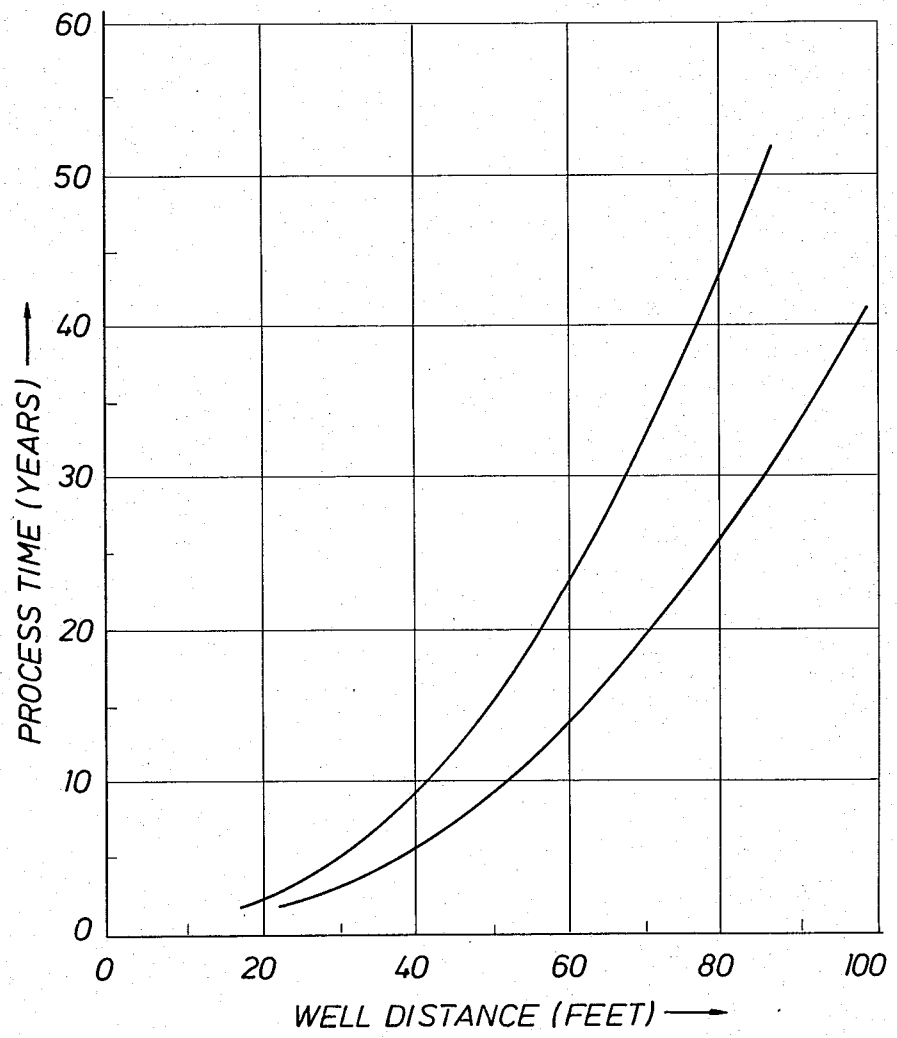
FIG. 4 is a plot of process time as a function of well spacing.

FIG. 4 illustrates the same point by showing that the process time is calculated to be appreciably shorter for the seven-spot (second curve) than for the five-spot (first curve), using the same well distance. Furthermore, this figure shows that well distances of about 65–70 feet are required to ensure that the process lifetime will be in the order of 20–30 years.

Figure 5:
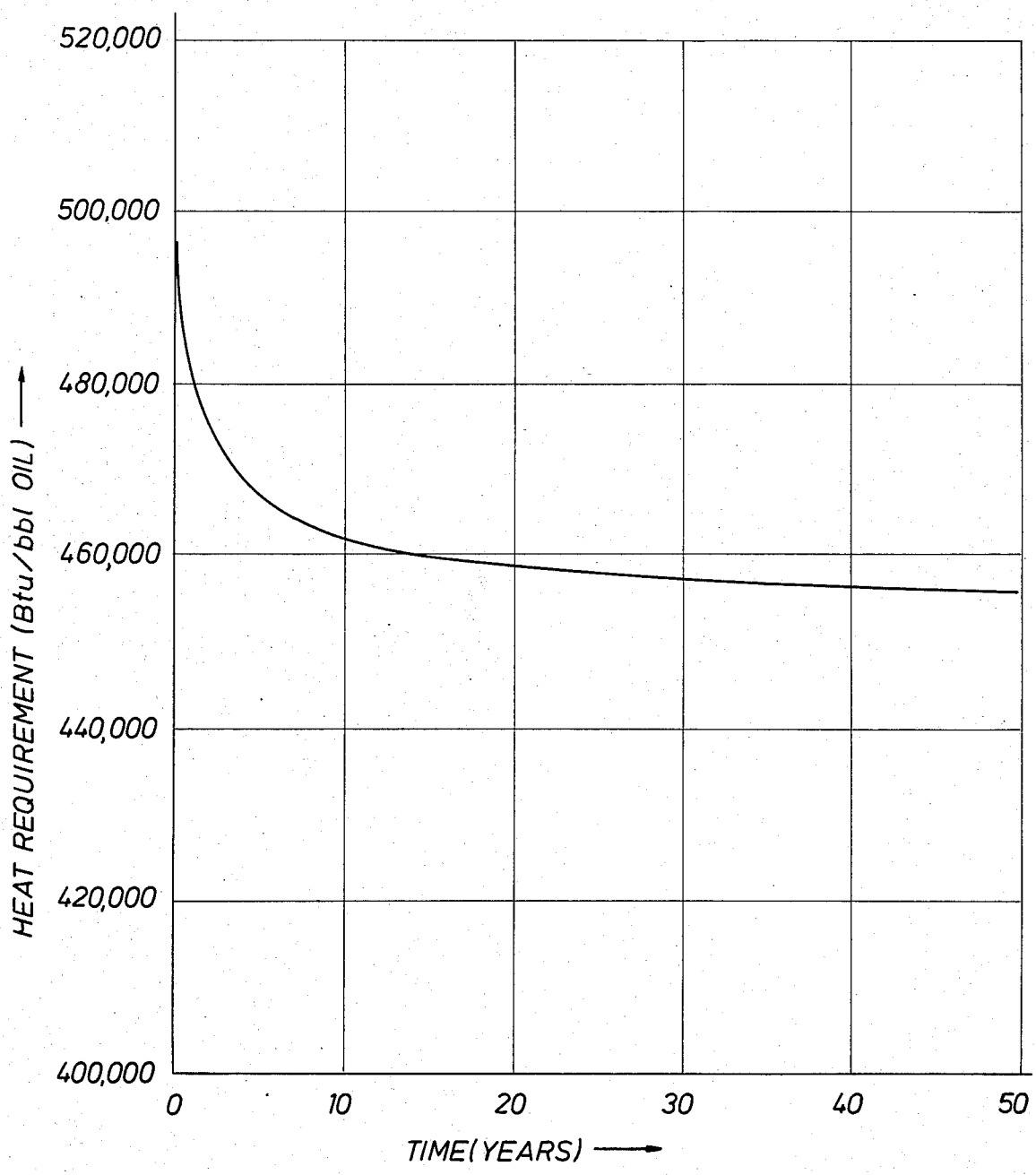
FIG. 5 is a plot of the heat requirement as a function of the process versus time.

FIG. 5 illustrates the heat requirements of the process. Except for early times about 460,000 Btu's are injected for every barrel of oil produced. The calculated value of the heat requirements is optimistic, since heat conduction downstream of the condensation front has been neglected.

As a consequence of our model, all fluids (oil and water) are assumed to be produced at original reservoir temperature. In reality, due to the conductive preheating downstream of the steam front, after a while the produced fluids will gradually heat up until they reach steam temperature (at which time the process will be concluded). Since heat conduction is a slow process, the fluids will be produced at original reservoir temperature for the first several years of the duration of the process. As a matter of fact, it can be shown that at least 25% of the fluids will be produced cold.

For a conservative estimate of the heat requirements we shall assume that 25% of the produced fluids will have a temperature equal to the original formation temperature, but that the remaining 75% of the fluids is produced at steam temperature. This very conservative assumption raises for our example case the heat requirement from 460,000 Btu/bbl to 760,000 Btu/bbl. The true value (accepting the validity of the other assumptions) should be in between these two numbers and, until we have developed a more accurate model, a value of about 600,000 Btu/bbl will be considered reasonable.

So far we have presented all results in terms of performance per individual well, or per single pattern. In these terms both injection and production rates appear to be of small magnitude. Assuming a well density of 10–12 wells per acre, we can expect to inject electric heat at the rate of about 730 Megawatts and produce oil at an average rate of 100,000 barrels per day for a period of 27 years, yielding a cumulative production of one billion barrels of oil.

SUITABLE COMPONENTS AND TECHNIQUES

The reservoir to be treated can comprise substantially any subterranean oil reservoir having a relatively thick oil-containing layer which is both significantly porous and contains significant proportions of oil and water but is so impermeable as to be undesirably unproductive of fluid in response to injections of conventional oil recovery fluids. Such a formation preferably has a product of porosity times oil saturation equalling at least about 0.15. The oil preferably has an API gravity of at least about 10 degrees and the water saturation is preferably at least about 30%. The invention is particularly advantageous for producing oil from reservoirs having a permeability of less than about 10 millidarcys. Additional examples of other reservoirs with similar characteristics include other diatomite formations in California and elsewhere and hydrocarbon-containing chalk formations, and the like.

The heat injection wells used in the present process can comprise substantially any cased or uncased boreholes which (a) extend at least substantially throughout a treatment interval of at least about 100 feet of a subterranean earth formation of the above-specified type (b) are arranged in a pattern of wells having boreholes which are substantially parallel throughout the treatment interval and are separated from adjacent wells by distances of from about 20 to 80 feet and (c) contain sheaths or barriers of solid materials which are heat-resistant, heat-conductive and substantially impermeable to fluid, arranged to prevent the flow of fluid between the interior of the borehole and the exposed faces of the reservoir formation and/or fractures in fluid communication with the borehole. As will be apparent to those skilled in the art, temperature fluctuations are generally tolerable in such a heating process, using either electrical resistance or combustion heating. The rate need only be an average rate along the interval being heated and is not seriously affected by fluctuations such as temporary shutdowns, pressure surges, or the like.

The fluid production wells used in the present invention can be substantially any wells in the above-specified pattern and arrangement which are adjacent to at least one heat injection well and which are in fluid communication with the reservoir formation at least substantially throughout the treatment interval and are arranged for producing fluid while maintaining a borehole fluid pressure which is lower than the reservoir fracturing pressure.

The means for heating the interior of the heat injecting well can comprise substantially any borehole heating device capable of increasing and maintaining the borehole interior temperatures by the above-specified amounts. Such heating devices can be electrical or gas-fired units, with an electrical unit being preferred. The heating elements are preferably arranged for relatively easy retrieval within a closed-bottom casing which is sealed to a heat-conductive, impermeable sheath which contacts the reservoir formation. The heating means is preferably arranged for both relatively quickly establishing a temperature of at least about 600° C. (preferably 800° C.) and for maintaining a temperature of less than 1000° C. (preferably 900° C.) for long periods while heat is being conducted away from the borehole interior at a rate not significantly faster than that permitted by the heat conductivity of the reservoir formation.

The heat-stable, heat-conductive and fluid-impermeable material which forms a barrier between the reservoir formation and the heater is preferably a steel tubing surrounded by heat conductive material in contact with the reservoir formation and/or fractures in fluid communication with the borehole. Since an inflow of fluid from the earth formations is apt to comprise the most troublesome type of fluid flow between the interior of the borehole and the reservoir, in some instances it may be desirable to pressurize the interior of such a barrier or sheath to prevent and/or terminate such an influx of fluid. Preferred gases for use in such a pressurization comprise nitrogen or the noble gases or the like. The material which surrounds such a barrier and contacts the reservoir formation should be substantially heat resistant and relatively heat-conductive at temperatures in the range of from about 600° to 1000° C. Heat resistanct cements or concretes are preferred materials for such a use in the present process. Suitable cements are described in patents such as U.S. Pat. No. 3,507,332.

We have now found that a number of inefficiencies in the thermal conduction process may occur in heterogeneous zones of formations such as the Belridge diatomite. Different formation thermal conductivities can result in uneven heater temperatures. Due to copper electric properties, a higher heat injection would take place into a less heat conductive "richer" layer than into a more conductive "poorer" layer. Since thermal conductivity is a function of bulk density, more porous diatomite zones would receive more heat than less porous ones. This would be undesirable as the more porous zones are also more permeable and an efficient process is possible in them at relatively low temperatures providing less heat input.

If a constant cross section heater is used in extreme cases, heat injection in the richer layers would continue after the process was completed in them. In the poorer layers not enough heat would be injected.

Therefore, a considerable improvement in process oil recovery and heat efficiencies can be obtained by providing relatively increased heat injection rates into the poorer layers which are less porous and less permeable. This can be achieved by using a variable cross section copper heater and/or using parallel heating cables and positioning more of them along the poorer layers than along the richer layers, or using other means for varying the rate of heating.

Figure 6:
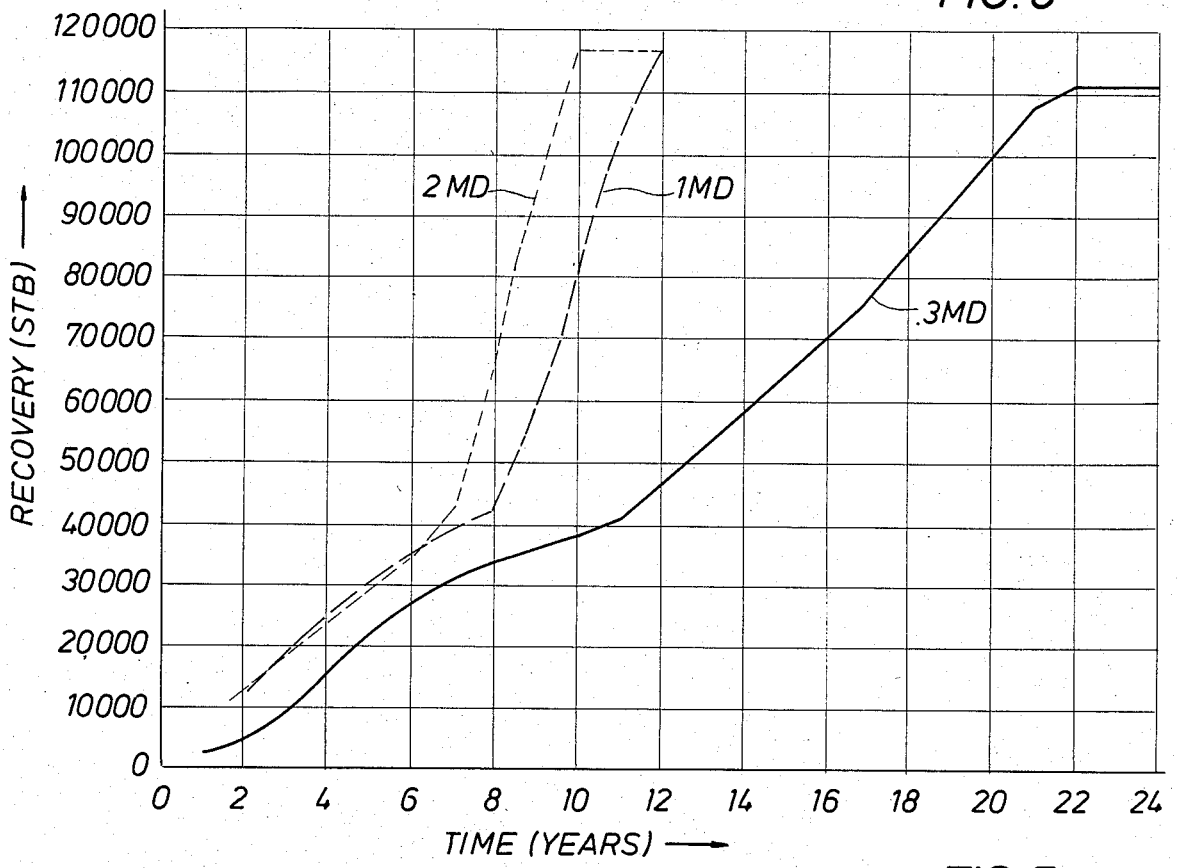
FIGS. 6 and 7 show plots of oil recovery with time for simulated thermal conduction processes in reservoir intervals containing layers of differing permeability.
Figure 7:
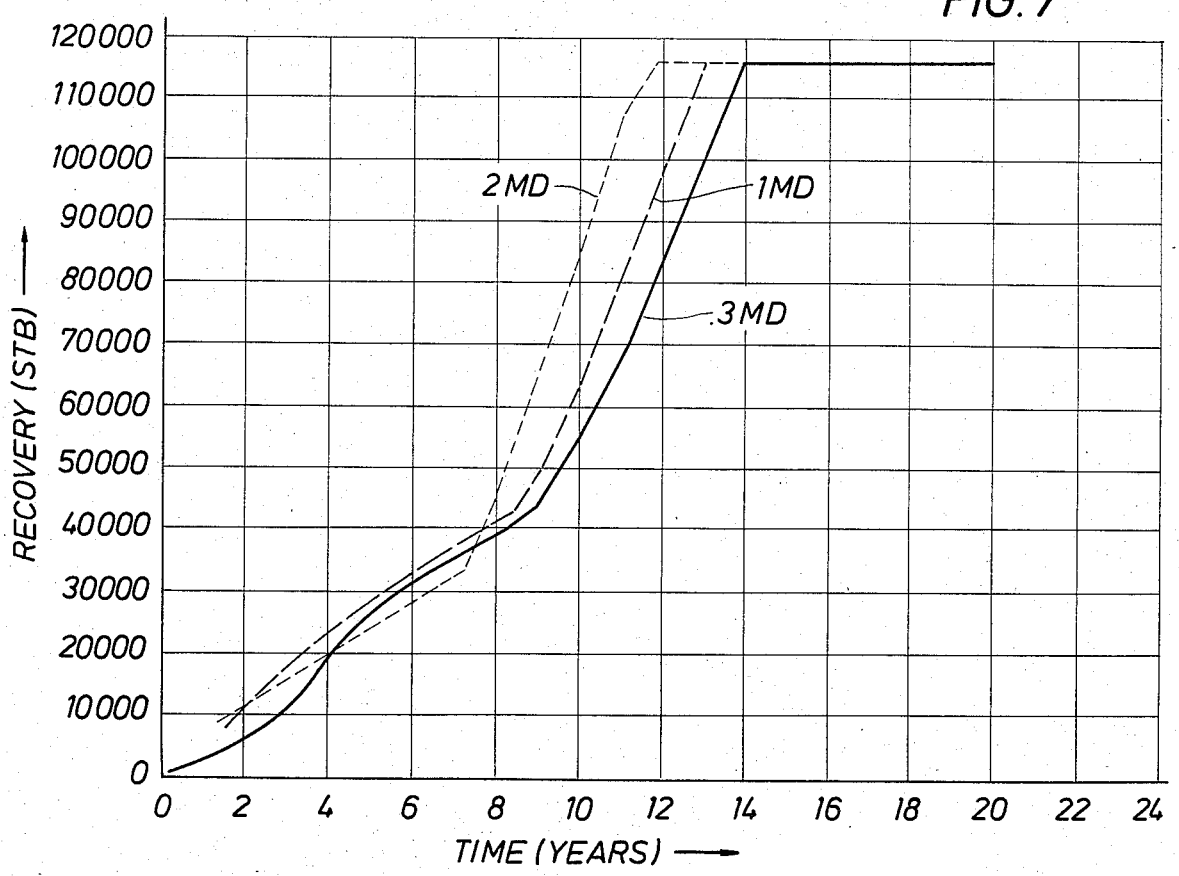

To illustrate the effect of permeability on process performance, mathematically simulated production functions for three layers of different permeabilities but the same other properties, are shown in FIGS. 6 and 7. The difference between the two cases is in heat injection rates. In FIG. 6 heat injection rates were the same for all permeabilities. The rates were, in watts per foot: 150 for 3 years; 125 for 3 years; 100 for 2 years and 75 for 3 years.

In FIG. 7 the rates of heat injection were different, in the 1 and 2 md layers they were decreased while for the 0.3 md layer they were increased. The rates into the 1 md layer were decreased by 10%, the rates into the 2 md layer were decreased by 15% and the rates into the 0.3 md layer were increased by 15%.

In the first case, (FIG. 6) heat was injected for 11 years. It may be seen that heat was continued to be injected in the most permeable layer, even though no additional oil could have been produced from it while not enough heat was available in the least permeable layer to complete the process.

In the second case, (FIG. 7) heat was injected until all layers provided the same recovery, while the overall heat consumption decreased. Although there was a delay in process completion in the 1 and 2 md permeability layers, the 0.3 md permeable one had a big improvement in oil recovery as well as process completion time.

A summary of process oil recovery and heat efficiencies is given in Table 1.

TABLE 1

SUMMARY OF PROCESS OIL RECOVERY AND HEAT EFFICIENCIES

| | Same Layer Heat Input | | | Modified Layer Heat Input | | |
|---|---|---|---|---|---|---|
| Layer (md) | 0.3 | 1.0 | 2.0 | .3 | 1.0 | 2.0 |
| Oil Recovery (%) | 8 | 84 | 84 | 83 | 83 | 83 |
| Heat Eff. (MBtu/STB) | 421 | 398 | 400 | 427 | 380 | 339 |
| Process Completion Time (Years) | 22 | 12 | 10 | 14 | 13 | 12 |

The improvement in heat efficiency indicated by the simulations amounted to about 10%. This suggests that use of the present modified heat input procedure may provide savings in the order of 10–15% in the recovery of a given amount of oil from reservoirs of the specified type.

In a preferred procedure, determination of layer heat injection rates in a given situation would be based on all known formation properties, as well as economic analysis. In some cases, overinjecting in some layers to obtain earlier oil production might be economically justifiable.

What is claimed is:

1. A process for heating a subterranean oil and water-containing reservoir formation, comprising:

completing at least one each of heat-injecting and fluid-producing wells into a treatment interval of said formation which is at least about 100 feet thick, contains both oil and water, and is both undesirably impermeable and non-productive in response to injections of oil recovery fluids;

arranging said wells to have boreholes which, substantially throughout the treatment interval, are substantially parallel and are separated by substantially equal distances of at least about 20 feet;

in each heat-injecting well, substantially throughout the treatment interval, sealing the face of the reservoir formation with a solid material which is relatively heat-conductive and substantially fluid impermeable;

in each fluid-producing well, substantially throughout the treatment interval, establishing fluid communication between the wellbore and the reservoir formation and arranging the well for producing fluid from the reservoir formation; and heating the interior of each heat-injecting well, at least substantially throughout the treatment interval, at a rate or rates capable of (a) increasing the temperature within the borehole interior to at least about 600° C. and (b) maintaining a borehole interior temperature of at least about 600° C. without causing it to become high enough to thermally damage equipment within the borehole while heat is being transmitted away from the borehole at a rate not significantly faster than that permitted by the thermal conductivity of the reservoir formation.

2. The process of claim 1 in which the treatment interval is at least about 300 feet thick, has a porosity and oil saturation such that the product of the porosity times the oil saturation is at least about 0.15, and has a permeability of less than about 10 millidarcys.

3. The process of claim 2 in which the treatment interval is a portion of Diatomite/Brown Shale formation in the Belridge Field.

4. The process of claim 3 in which the means for heating the borehole interior of the heat injection well is arranged to maintain a temperature of from about 600° to 900° C.

5. The process of claim 1 in which the means for heating the interior of at least one heat injection well is an electrical heater.

6. The process of claim 1 in which the solid material which is sealed against the face of the reservoir formation is a heat conductive cement or concrete.

7. The process of claim 1 in which a plurality of heat injection and fluid production wells are arranged substantially vertically in a five-spot, seven-spot or thirteen-spot pattern.

8. A process for conductively heating an oil-containing Diatomite/Brown Shale formation at a depth of at least about 400 feet in the Diatomite/Brown Shale formation in the Belridge field in a manner capable of initiating conductive heat-induced oil production within about two years comprising:

completing at least two wells into said reservoir formation;

arranging said wells so their boreholes extend for distances of at least about 100 feet through a treatment interval within said formation, are substantially parallel throughout the treatment interval and are separated, at least within that interval, by distances of from about 20 to 80 feet;

arranging at least one of said wells for heat injection by sealing the borehole, at least substantially throughout the treatment interval, with a solid material which is heat-resistance, heat-conductive and substantially impermeable to fluid, and is sealed against the face of the reservoir formation and/or fractures in fluid communication with the borehole;

installing and operating within each heat injection well means for heating the borehole interior, at least substantially throughout the treatment interval at a rate or rates capable of (a) increasing the borehole interior temperature to at least about 600° C. and (b) supplying heat at a rate capable of maintaining a borehole interior temperature of between about 600° to 900° C. without increasing that temperature enough to damage equipment within the borehole while heat is being transmitted away from the borehole at a rate not significantly faster than that permitted by the heat conductivity of the reservoir formation; and arranging at least one of said wells which is adjacent to at least one heat injection well as a fluid production well by opening it into fluid communication with the reservoir formation, at least throughout substantially all of the treatment interval, and equipping and operating it for producing fluid while maintaining a relatively low pressure against the reservoir formation.

9. The process of claim 8 in which the means for heating the interior of at least one heat injection well is an electrical heater.

10. The process of claim 8 in which the solid material which is sealed against the face of the reservoir formation is a heat conductive cement or concrete.

11. The process of claim 8 in which a plurality of heat injection and fluid production wells are arranged substantially vertically in a five-spot or seven-spot pattern.

12. A process for heating a subterranean oil and water-containing reservoir formation, comprising:

completing at least one each of heat-injecting and fluid-producing wells into a treatment interval of said formation which is at least about 100 feet thick, contains both oil and water, and is both undesirably impermeable and non-productive in response to injections of oil recovery fluids;

arranging said wells to have boreholes which, substantially throughout the treatment interval, are substantially parallel and are separated by substantially equal distances of at least about 20 feet;

in each heat-injecting well, substantially throughout the treatment interval, forming a fluid-impermeable barrier between the face of the reservoir formation and an interior portion of the borehole, with said barrier comprising at least one solid material which is relatively heat-conductive and substantially fluid impermeable;

in each fluid-producing well, substantially throughout the treatment interval, establishing fluid communication between the wellbore and the reservoir formation and arranging the well for producing fluid from the reservoir formation; and heating said barrier-isolated portion of the interior of each heat-injecting well, at least substantially throughout the treatment interval, at a rate or rates capable of (a) increasing the temperature within the borehole interior to at least about 600° C. and (b) maintaining a borehole interior temperature of at least about 600° C. without causing it to become high enough to thermally damage equipment within the borehole while heat is being transmitted away from the borehole at a rate not significantly faster than that permitted by the thermal conductivity of the reservoir formation.

13. The process of claim 12 in which the heating is continued until fluid is displaced into the borehole of at least one fluid-producing well, and the outflowing of fluid from each fluid-producing well into which fluid is being displaced is restricted to the extent required to increase the fluid pressure within the well by an amount sufficient to prevent significant compaction of the adjacent reservoir formation.

14. The process of claim 13 in which said fluid pressure is increased to about 100 to 200 psi more than the natural hydrostatic pressure in the adjacent earth formations.

15. The process of claim 12 in which the rate of said heating is or is equivalent to about 340 to 680 BTU per foot per hour.

16. The process of claim 12 in which said fluid-impermeable barrier is formed by heat-resistant casing which is fluid tightly closed at its lower end and is surrounded by cement.

17. The process of claim 16 in which said barrier-surrounded interior portion of the borehole is heated by an electrical resistance heater operating at a rate of about 100–200 watts per foot.

18. A thermal conduction process for displacing oil through a subterranean oil and water-containing reservoir formation toward a production location, comprising:

completing at least one each of heat injecting and fluid producing wells into a treatment interval of said formation which is at least 100 feet thick, contains both oil and water, is both undesirably impermeable and nonproductive in response to injections of oil recovery fluids, and contains at least one relatively less permeable layer in which the permeability is significantly less than that of at least one other layer within the treatment interval;

arranging said wells to have boreholes which, substantially throughout the treatment interval, are substantially parallel and are separated by substantially equal distances of at least about 20 feet;

in each heat-injecting well, substantially throughout the treatment interval, sealing the face of the reservoir formation with a solid material which is relatively heat-conductive and substantially fluid impermeable;

in each fluid-producing well, substantially throughout the treatment interval, establishing fluid communication between the wellbore and the reservoir formation and arranging the well for producing fluid from the reservoir formation;

determining the location along at least one heat injecting well at which said relatively less permeable layer is encountered; and heating the interior of each heating well at least substantially throughout the treatment interval at a rate or rates capable of (a) increasing the temperature within the borehole interior to at least about 600° C., (b) maintaining a borehole interior temperature of at least about 600° C. without causing it to become high enough to thermally damage equipment within the borehole while heat is being transmitted away from the borehole at a rate not significantly faster than that permitted by the thermal conductivity of the reservoir formation, and (c) in at least one heat injecting well, increasing the relative rate of injecting heat along at least one relatively less permeable layer to a rate exceeding that along at least one more permeable layer by an increased amount related to the increased amount of permeability in the relatively more permeable layer.

19. The process of claim 18 in which the heat injecting wells are heated with electrical resistance elements and, in at least one, the heating elements are arranged so that the resistance per unit length of the heater is relatively higher along a relatively less permeable layer in order to provide said relatively high rate of heat injecting.

20. The process of claim 18 in which the heat injecting wells are heated with electrical resistance elements and in at least one well, the heating elements are arranged to include a plurality of resistance heating elements in parallel within the treatment interval and the number of such elements is greater along a relatively less permeable layer than along at least one other layer within the interval in order to provide said relatively high rate of heating.

* * * * *